US009802777B2

(12) United States Patent
Rietbergen et al.

(10) Patent No.: US 9,802,777 B2
(45) Date of Patent: Oct. 31, 2017

(54) BELT CONVEYOR SYSTEM COMPRISING A MESH BELT AND A SHEET CONVEYOR SYSTEM FOR CONVEYING SHEETS IN A REPROGRAPHIC APPARATUS

(71) Applicant: Océ-Technologies B.V., Venlo (NL)

(72) Inventors: Mark Rietbergen, Venlo (NL); Kevin H.J.R. Prinsen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/600,052

(22) Filed: May 19, 2017

(65) Prior Publication Data

US 2017/0275113 A1 Sep. 28, 2017

Related U.S. Application Data

(63) Continuation of application No. PCT/EP2015/077907, filed on Nov. 27, 2015.

(30) Foreign Application Priority Data

Nov. 28, 2014 (EP) ..... 14195331

(51) Int. Cl.
*B65H 7/14* (2006.01)
*B65H 5/22* (2006.01)
(Continued)

(52) U.S. Cl.
CPC ..... *B65H 7/14* (2013.01); *B65H 5/224* (2013.01); *B65H 7/02* (2013.01); *B65H 29/242* (2013.01);
(Continued)

(58) Field of Classification Search
CPC ... B65H 7/14; B65H 5/24; B65H 7/02; B65H 29/242
(Continued)

(56) References Cited

U.S. PATENT DOCUMENTS 3,741,116 A 6/1973 Green et al.
4,815,587 A * 3/1989 Musil ..... B65G 15/52 198/728
(Continued)

FOREIGN PATENT DOCUMENTS

EP 2 684 821 A1 1/2014

OTHER PUBLICATIONS

International Search Report (PCT/ISA/210) issued in PCT/EP2015/077907, dated Mar. 30, 2016.
(Continued)

*Primary Examiner* — Douglas Hess
(74) *Attorney, Agent, or Firm* — Birch, Stewart, Kolasch & Birch, LLP

(57) ABSTRACT

Belt conveyor system comprising: an endless mesh belt, the belt having a mesh structure and having edge areas at the lateral sides, a drive mechanism drivable by a drive motor to rotate the belt, and a steering roller for steering the lateral position of the belt, wherein an edge area comprises a band running substantially parallel to the lateral sides, the band comprising an elastic filler being provided inside the mesh structure, the elastic filler being discernible from the mesh structure, and wherein the belt conveyor system further comprises a band position detector for detecting the lateral position of the band.

13 Claims, 6 Drawing Sheets

(51) Int. Cl.
*B65H 29/24* (2006.01)
*B65H 7/02* (2006.01)
*G03G 15/00* (2006.01)

(52) U.S. Cl.
CPC .... *G03G 15/6529* (2013.01); *B65H 2404/211* (2013.01); *B65H 2404/224* (2013.01); *B65H 2404/271* (2013.01); *B65H 2404/282* (2013.01); *B65H 2404/283* (2013.01); *B65H 2511/20* (2013.01); *B65H 2553/412* (2013.01); *B65H 2553/414* (2013.01); *B65H 2553/416* (2013.01); *B65H 2801/06* (2013.01)

(58) Field of Classification Search
USPC ..... 198/689.1, 810.02, 810.03, 810.04, 848
See application file for complete search history.

(56) References Cited

U.S. PATENT DOCUMENTS 5,090,683 A * 2/1992 Kamath ..... B65H 5/34 271/184
5,119,938 A 6/1992 Beckh et al.
6,106,391 A * 8/2000 Tjabringa ..... A01D 17/10 198/848
6,237,754 B1 * 5/2001 Tjabringa ..... B65G 15/52 198/803.14
7,182,202 B2 * 2/2007 Kalverkamp ..... B65G 17/44 198/698
7,905,346 B2 * 3/2011 Enomoto ..... B41J 11/007 198/807
8,330,452 B2 * 12/2012 Furukawa ..... B65G 43/02 198/444
8,737,890 B2 * 5/2014 Nakamura ..... G03G 15/1605 198/806
9,334,122 B2 * 5/2016 Shoji ..... B65G 15/30
9,656,809 B1 * 5/2017 Bradshaw ..... B65G 17/063
2009/0145729 A1 6/2009 Enomoto

OTHER PUBLICATIONS

Written Opinion of the International Searching Authority (PCT/ISA/237) issued in PCT/EP2015/077907, dated Mar. 30, 2016.

* cited by examiner

BELT CONVEYOR SYSTEM COMPRISING A MESH BELT AND A SHEET CONVEYOR SYSTEM FOR CONVEYING SHEETS IN A REPROGRAPHIC APPARATUS

CROSS REFERENCE TO RELATED APPLICATIONS

This application is a Continuation of PCT International Application No. PCT/EP2015/077907, filed on Nov. 27, 2015, which claims priority under 35 U.S.C. 119(a) to Patent Application No. 14195331.5, filed in Europe on Nov. 28, 2014, all of which are hereby expressly incorporated by reference into the present application.

The present invention relates to a belt conveyor system comprising a mesh belt.

The present invention also relates to a sheet conveyor system for conveying sheets in a reprographic apparatus.

The present invention further relates to a reprographic apparatus comprising such a sheet conveyor system.

The present invention further relates to a conveyor belt for such a conveyor system.

BACKGROUND OF THE INVENTION

Belt conveyor systems are used in many different applications to transport material from one place to another. In reprographic apparatuses such as printers and copiers, belt conveyor systems are used to convey sheets of receiving material through the apparatus. For example, from a sheet input tray to a transfer roll, from a transfer role to a fuser, from a fuser to a finishing device such as a stapler or a folder, and from a finishing device to an output tray.

One type of belt used in reprographic apparatuses is a mesh belt that is held under tension between two or more rollers. At least one roller is driven to rotate the belt. The belt runs over a vacuum plate which is a perforated plate that forms the side of a vacuum box. In the vacuum box a partial vacuum is kept. This partial vacuum forces air outside the box to be sucked through the mesh belt and the perforations into the box. A sheet positioned on the mesh belt is therewith sucked against the mesh belt and moved with the moving belt moving the sheet from a first point to a second point.

In belt conveyor systems in general, it is known to provide the belt near the edges with markings to create an alternating pattern near the edge. The pattern makes it possible to determine the belt velocity. It is further known to determine an inclination of the belt by calculating a difference in belt velocity between the two edges.

It is not obvious though to determine a lateral belt position from the inclination of the belt.

When applying mesh belts, it is known to weave a pattern into the mesh fabric by alternating high density weave areas with low density weave areas. Monitoring the pattern during operation enables the determination of the lateral position of the belt.

The problem with a mesh comprising high density areas and low density areas is that this leads to non-uniform properties of the belt across its surface. In for example a sheet conveyor system in a reprographic apparatus this may lead to ripples and even creases in the sheets being conveyed, resulting in poor image reproduction quality or even jams in the sheet conveyor system.

It is an object of the present invention to provide a belt conveyor system with lateral position detection with the disadvantages of the prior art at least mitigated.

SUMMARY OF THE INVENTION

The object of the invention is obtained by providing a belt conveyor system comprising: an endless mesh belt, the belt having a mesh structure and having edge areas at the lateral sides, a drive mechanism drivable by a drive motor to rotate the belt, and a steering roller supporting the belt and arranged for steering the lateral position of the belt, wherein an edge area comprises a band running substantially parallel to the lateral sides, the band comprising an elastic filler being provided inside the mesh structure, the elastic filler being discernible from the mesh structure, and wherein the belt conveyor system further comprises a band position detector for detecting the lateral position of the band.

An endless belt is a belt that forms a loop. A mesh structure as defined herein is an open structure composed by a mesh material, such as a woven fabric. The mesh structure comprises mesh elements, such as threads or fibres, and open areas or spaces interposed between the mesh elements. The mesh elements, such as threads or fibres, may comprise a polymeric material, a non-synthetic natural material, such as cotton, a metal containing material or any other suitable material, The belt has two edges, namely adjacent to the two openings in the loop. In an area near an edge a band has been provided by inserting a filler material in the mesh structure of the belt. The filler material is sufficiently elastic such that the movements of the belt are not or are hardly hampered by the filler material.

The filler material is discernible from the mesh structure allowing the band position detector to distinguish between the mesh structure and the band. The distinguishing property may be an optical property, for example the filler material and the mesh structure may have optically distinguishable properties such as transparent versus opaque, or reflective versus non-reflective. Alternatively, magnetic properties may be used such as magnetic material versus non-magnetic material; or inductive or capacitive properties by using conductive properties of materials. Other material properties may be used. The properties provided here share the advantage that the band position detector can operate contactless.

The drive mechanism may be a drive roller being driven by the drive motor to rotate, i.e. circulate, the endless belt, and may be the steering roller being driven by the drive motor to rotate, i.e. circulate, the endless belt.

As the band position detector is able to distinguish between the mesh structure without the filler material and the filler material, it is able to detect whether the filler material is within range of the detector or the mesh structure without the filler material. During operation the belt will be running. If the belt moves laterally, the band position detector will reflect this either by a change in magnitude or phase shift of the property being detected (light intensity, magnetic field strength, induction, or capacitance), or—if the detector is a compound detector comprising sub-detectors arranged in for example an array—a shift of an extreme in the detected signal among sub-detectors.

In an advantageous embodiment, a belt conveyor system is provided, wherein the filler is substantially opaque and the band position detector comprises a light source and a light detector positioned on opposing sides of the band and wherein depending on the lateral position of the belt light from the light source is substantially blocked or not by the band. The band, comprising an opaque filler material, will block the light beam between the light source and the light detector as long as the band is positioned between the light source and the light detector. This will cause the light detector to detect a low light intensity. If the band moves laterally, the light beam will no longer be blocked, or only be partially blocked, causing the light detector to detect a high light intensity. The mesh structure in the central area 114 will hardly block the light due to its open structure. Optionally, the material the mesh is made of is itself wholly or partially transparent.

In an alternative embodiment, a belt conveyor system is provided, wherein the band position detector comprises a light source and a light detector positioned on the same side of the band and wherein depending on the lateral position of the belt light from the light source is substantially reflected to the light detector.

In a further embodiment, a belt conveyor system is provided, wherein: the filler is substantially reflective, or, alternatively, the filler is substantially non-reflective and a substantially reflective surface is provided at the side of the mesh opposite the light detector.

In the case where the filler is substantially reflective, the reflectivity is preferred to refer to diffuse reflectivity, as other types of reflection, such as specular reflection, make the band position detector very sensitive to movement in the direction perpendicular to the mesh surface, especially if the belt velocity increases. If the filler is substantially reflective, there should be no reflective surface in the area opposite the light source and light detector in order to prevent light from the light source shining through the (substantially transparent) mesh belt and being reflected by this reflective surface back to the light detector causing an incorrect detection of the band when the band has moved laterally away from the light detector. This may be realised by having a non-reflective surface at the opposite side of the mesh belt, or alternatively no surface causing the light to be dispersed in the open space passed the mesh surface.

In a further advantageous embodiment, a belt conveyor system is provided, wherein the light detector comprises an array of light sensitive elements positioned along at least part of a lateral axis of the belt. In a light detector with a single light sensitive element, the light detector is only able to detect whether light hits the detector or not. This allows the light detector to determine whether the light is blocked or not, or possibly, whether the light is partially blocked. An array of light sensitive elements in contrast allows for detecting a position of the band within a range covered by the array by determining the light sensitive element or elements with the minimum or maximum detected light level.

In an even further advantageous embodiment a belt conveyor system is provided, wherein the filler material does not extend outside the mesh structure. Such embodiments are specifically advantageous in conveyor systems where the edge area comes in contact with a surface such as a vacuum plate or guidance surface. The filler material staying within the boundaries of the mesh structure prevents the filler material contributing to friction of the belt movement, and wear of the filler material resulting in deterioration of the detection of the band by the band position detector.

In an advantageous embodiment, a belt conveyor system is provided, further comprising a suction plate disposed along at least part of the surface of the belt and comprising a suction area provided with suction holes, and wherein the edge area comprising the band does not overlap with the suction area. The advantage of the edge area comprising the band and the suction area not overlapping is two-fold: Firstly, the reduced risk of increased friction due to the filler material touching the suction plate due to deformation of the mesh structure in the edge area when the mesh belt is sucked against the suction plate. Secondly, the reduction of wear of the mesh belt due to the mesh belt being sucked more strongly against the suction plate in the edge area due to the filler material forming a restriction for the air being sucked through the mesh belt.

In a further embodiment, a belt conveyor system is provided, wherein both edge areas comprise a band. Although having a band in both areas allows for the installation of an additional band position detector, increasing the reliability of the detection, another advantage of using a mesh belt with both edge areas comprising a band is the more symmetrical mechanical behaviour of the belt.

In an even further embodiment, a belt conveyor system is provided, wherein the two bands are positioned substantially symmetrical in the belt.

In an advantageous embodiment, a belt conveyor system is provided, wherein the filler comprises rubber. Due to the flexibility of rubber, the influence of the filler material on the mechanical behaviour of the belt is reduced. Furthermore, belts with rubber filler material can be easily manufactured, for example by injecting the rubber in the mesh structure.

In a further advantageous embodiment, a belt conveyor system is provided, wherein the belt is seamless. Seamless belts are preferred over belts with seams as the more uniform construction of the belt increases, in particular in reprographic systems, the uniformity of the image quality as the sheets are being held more straight. Furthermore, due to the uniformity the partial vacuum underneath the sheets is more uniform resulting in a more uniform drying time of the sheets and therefore more uniform image quality.

In a specific embodiment, a sheet conveyor system is provided specifically arranged for conveying sheets of registration media in a reprographic apparatus. Belts for reprographic apparatuses should be as smooth as possible to ensure a uniform image quality. Therefore, a thin mesh structure is preferred. A thin mesh structure further reduces leakage at the sides. The open structure of a mesh belt also results in a low friction between the belt and the suction plate.

In a further embodiment, a reprographic apparatus is provided comprising such a belt conveyor system. Examples of such reprographic apparatuses are printers, copiers, faxes, and finishers.

In another embodiment, such a conveyor belt is provided.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
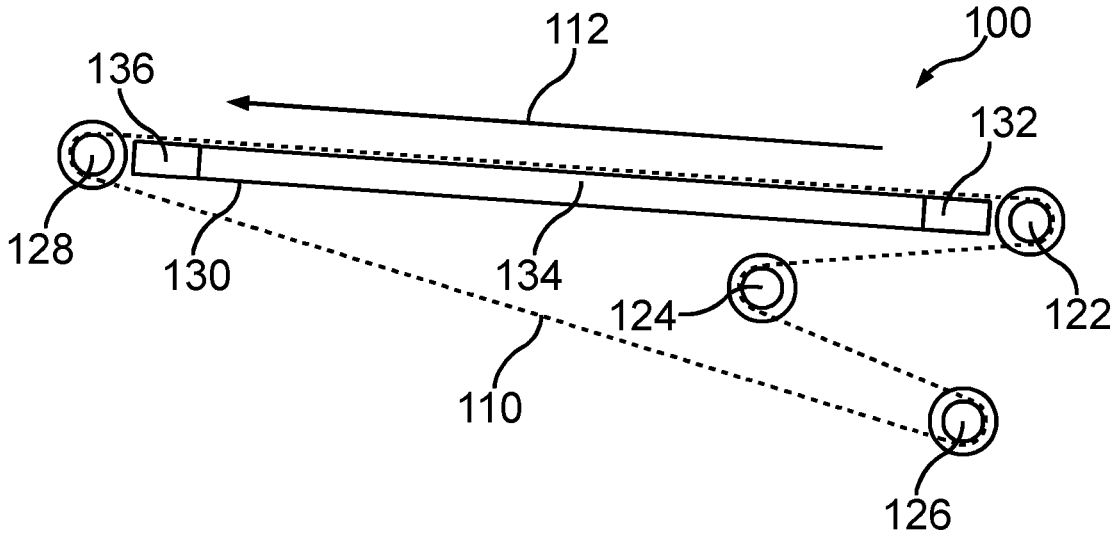
FIG. 1 is a diagram of an embodiment of a belt conveyor system according to the present invention.

The present invention will now be described with reference to the accompanying drawings, wherein the same reference numerals have been used to identify the same or similar elements throughout the several views.

In one embodiment a belt conveyor system 100 (FIG. 1) comprises a conveyor belt 110. The belt 110 is endless in the sense that it does not have a leading edge, nor a trailing edge. An endless belt may be formed by welding the leading edge and the trailing edge together resulting in a seam running over the width of the belt at the location where the leading and trailing edges have been welded together. In general the properties of the belt at the seam differ from the properties of the belt at other locations, for example, the belt thickness may be different due to overlap of the leading and trailing edges, and the stiffness of the belt may be different due to this same overlap, but also as a result of the welding process.

In sheet conveyor systems seamless belts 110 are preferred. Seamless belts are less subject to out-of-plane buckling. There is no danger of sheets being located on the seam, which increases sheet holding and reduces print defects. Furthermore, belt conveyor systems with seamless belts are less susceptible to wear.

Seamless belts may be manufactured by weaving tube-like forms and cutting the tube in a plane perpendicular to the longitudinal axis. Alternatively, an endless belt may be formed by taking a rectangular shaped mesh and welding two opposing sides together thereby forming a loop.

The belt 110 is a mesh belt comprising a woven fabric. In this specific embodiment the mesh is woven from threads with a thickness of approximately 0.22 mm and with a thread density of 12 threads per cm. One particular belt has a length of 1911 mm, a width of 420 mm, and a thickness is 0.5 mm. The threads comprise polyphenylene sulphide (PPS). Such a mesh belt has proven to be suitable for a sheet conveyor system in a reprographic apparatus. Alternatively, polyester may be used although PPS is preferred as the latter material is self-extinguishing.

The belt 110 is held under tension in a four roller configuration, namely a first roller 122, a steering roller 124, a tension roller 126, and a drive roller 128. The steering roller 124 is a pivoting steering roller that moves the belt in a lateral direction by using the helix principle. The tension roller 126 is movable in the direction of at the one hand the steering roller 124 and the drive roller 128 and at the other hand away from these rollers. By moving the tension roller 126 and adjusting the distance to the drive roller 128 and the steering roller 124, the tension of the belt can be controlled. The drive roller 128 is driven by a motor (not depicted) and makes the conveyor belt run in an operational direction depicted by arrow 112.

The mesh belt runs over a vacuum box 130. During operation a partial vacuum exists in the vacuum box 130. The surface of the vacuum box 130 facing the mesh belt 110 (called the suction plate) is perforated. Due to the partial vacuum, sheets on the belt 110 are held against the belt 110 between the first roller 122 and the drive roller 128 and move together with the belt 110 in the direction of the arrow 112. The suction plate comprises ABS with a Teflon coating. In combination with a mesh belt 110 comprising threads of PPS a low friction between suction plate and mesh belt 110 is obtained.

The vacuum box 130 is sub-divided in three vacuum chambers 132, 134, and 136. The suction plate of the vacuum chamber 132 is designed to have a high air flow in order to reliably receive sheets from a preceding sheet transportation unit, especially in the case of short sheets. When a sheet is in the vicinity of the belt 110 in the area of the vacuum chamber 132 it is forced towards the belt 110 by the high air flow. The vacuum chamber 134 is held on a moderate partial vacuum to prevent cockling of the sheet and ensure a reliable transport of the sheet. The vacuum chamber 136 is designed similar like vacuum chamber 132. A high pressure ensures reliable delivery of especially short sheets to the next sheet transportation unit.

The use of a mesh belt 110 ensures a better spreading of the partial vacuum underneath the sheets compared to perforated foil belts. Furthermore, a mesh belt 110 does not suffer from the problems of misalignment between the perforations in the perforated foil belt and the perforations in the suction plate, which systems comprising a perforated foil belt attempt to mitigate by milling grooves in the suction plate to distribute the partial vacuum.

Figure 2:
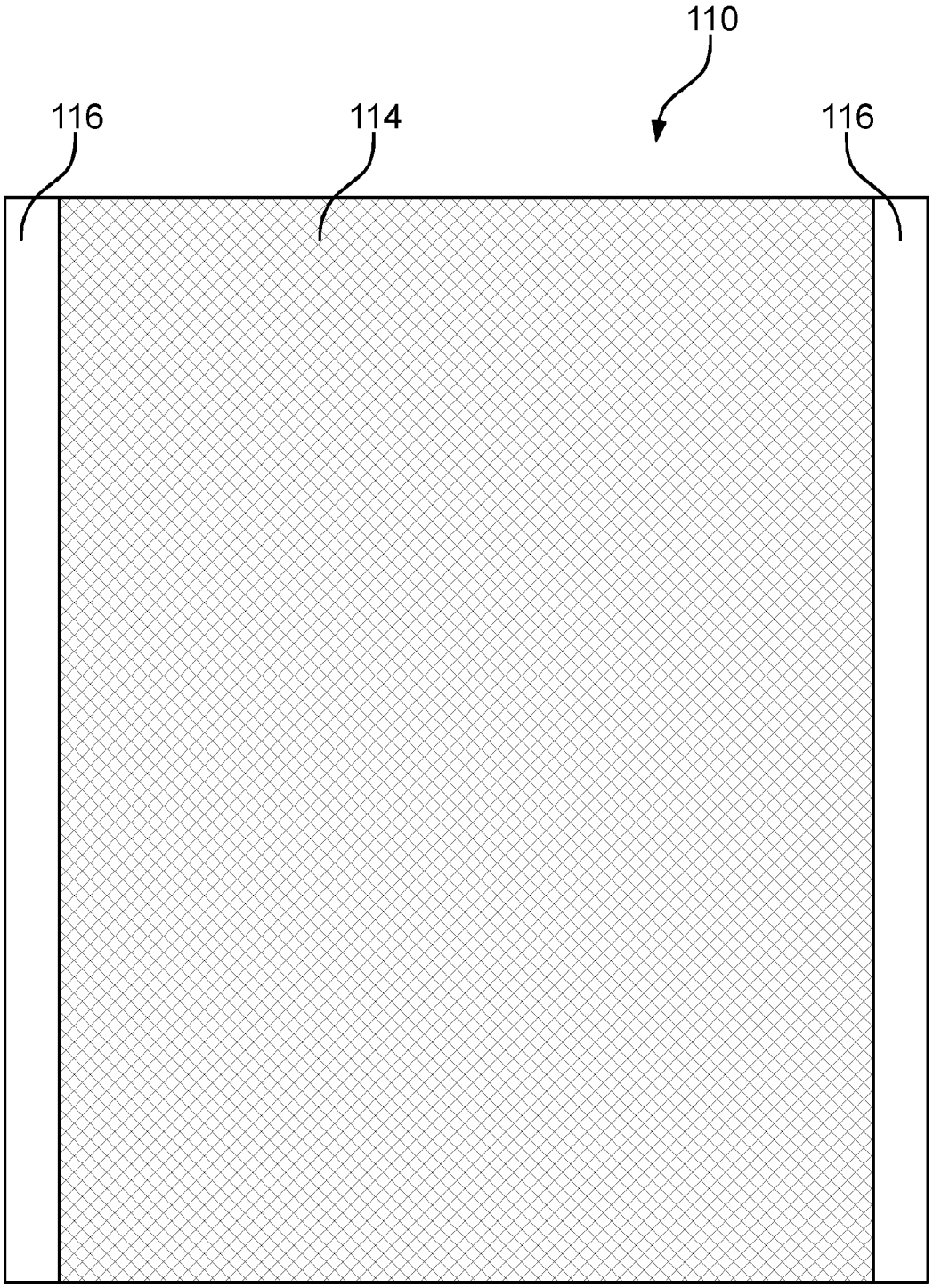
FIG. 2 is a diagram of an embodiment of a belt for use in the belt conveyor system of FIG. 1.

FIG. 2 shows a top view of the belt 110. The mesh belt 110 comprises a mesh structure. The mesh structure comprises a woven fabric. The majority of the belt 110, specifically the central area 114 (relative to the lateral direction) of the mesh structure has an open structure. This causes the vacuum to be substantially evenly distributed underneath a sheet being held on top of the belt. Due to this open structure it is not necessary for the suction plate of the vacuum box 130 to have a milled structure for distributing the partial vacuum as is necessary with perforated foil belts. As the dominant air restriction is in the suction plate and not in the belt 110, there is little friction between the belt 110 and the suction plate in the areas where no sheets are present. The edge areas of the belt 110 are each provided with a band 116. This band comprises of a non-transparent, flexible filler material that is provided inside the mesh structure.

Figure 3:
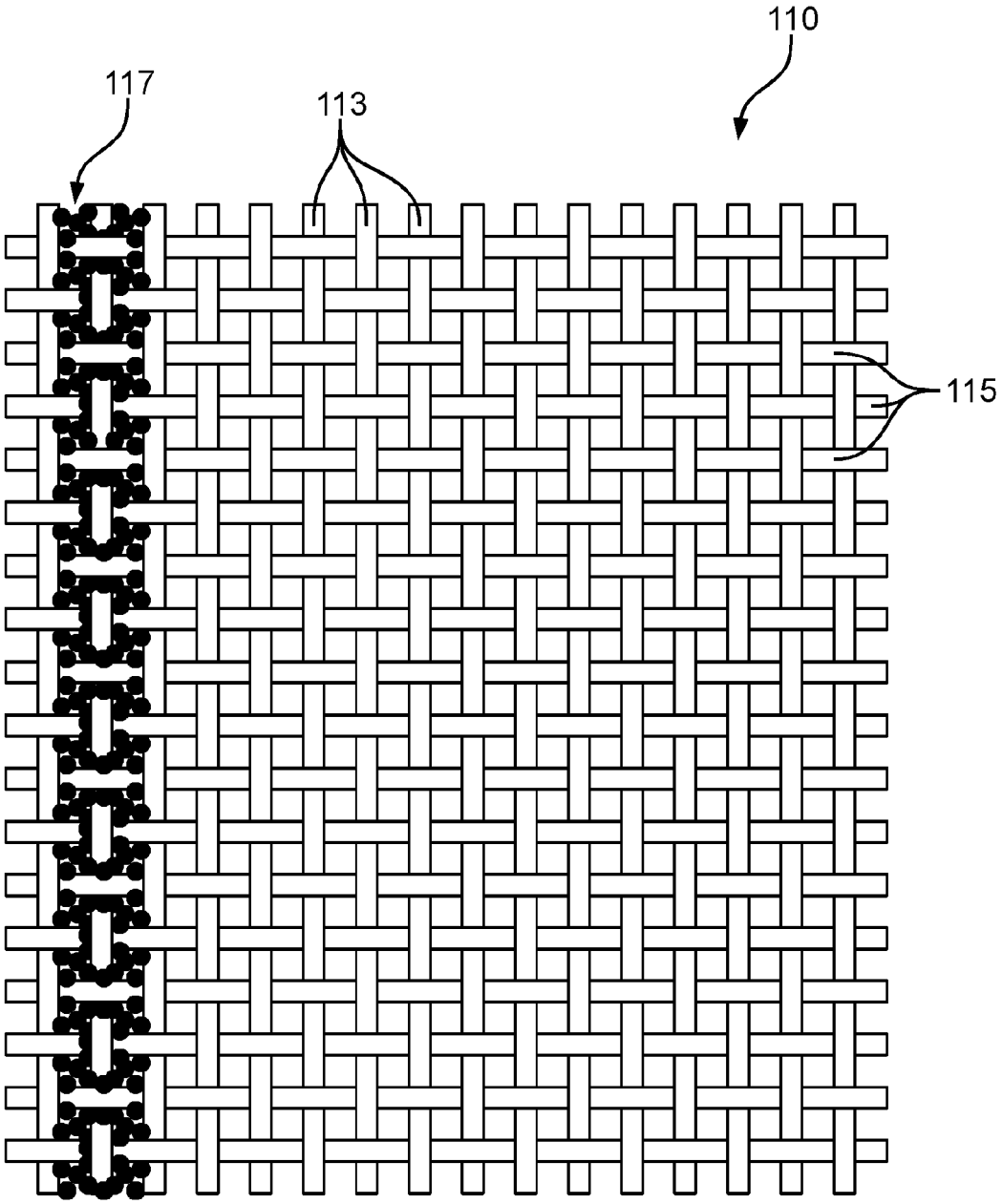
FIG. 3 is a diagram of a detail of an edge of the belt of FIG. 2.

FIG. 3 shows a detail of the edge area of the belt 110. The mesh belt 110 comprises a weft 113 and warps 115. At the edge a filler material 117 has been provided in the mesh structure. The filler material 117 is made of a non-transparent, flexible material, such as rubber. For example, rubber granulate welded together. In image reproducing apparatuses, such as copiers and printers, a granulate may be disadvantageous though due to pollution of the apparatus by detached granulates. This may be solved by using smearing or injecting latex into the mesh structure, scraping off the superfluous latex, and vulcanising the latex. Other elastomers are suitable too though.

The edge of the mesh belt (to the left of the band of filler material 117, has been cut using ultrasonic cutting techniques. The advantage of using ultrasonic cutting is that the warps 115 are welded together in the cutting process preventing unravelling of the mesh structure.

Figure 4:
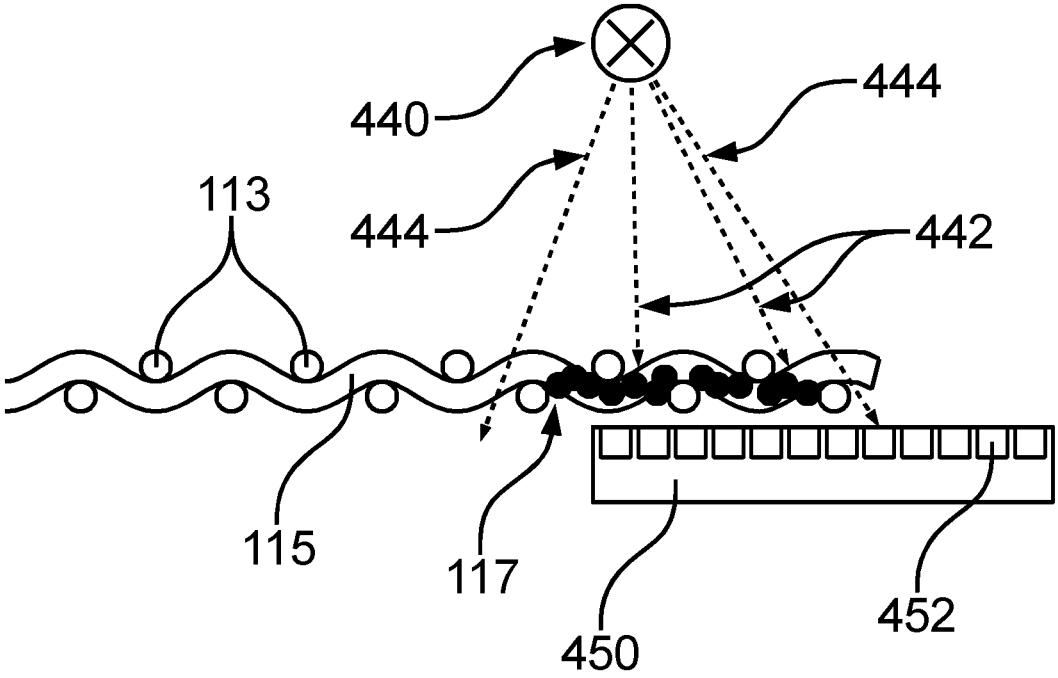
FIG. 4 is a diagram of an embodiment of a band position detector for use in the belt conveyor system of FIG. 1.
Figure 5A:
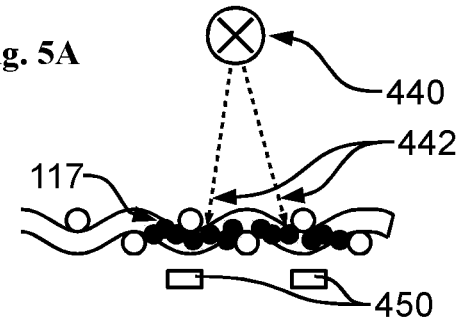
FIGS. 5A-D and 6A-C are diagrams showing various configurations of band position detectors for use in the belt conveyor system of FIG. 1.
Figure 5B:
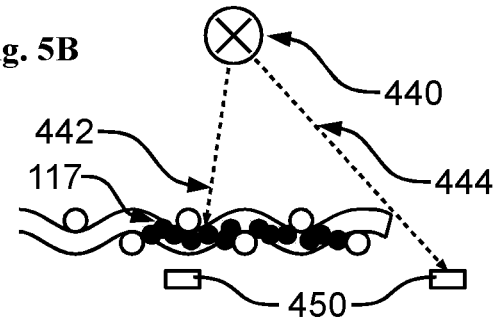
Figure 5C:
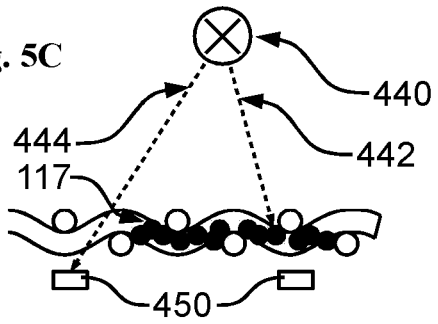
Figure 5D:
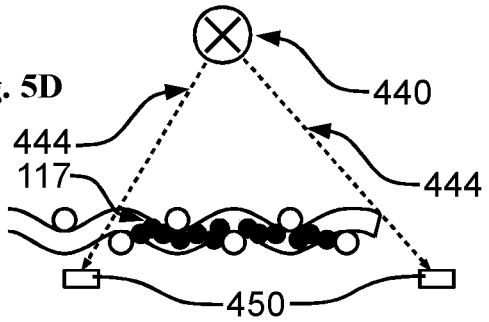

FIG. 4 shows a cross-sectional view of the belt 100 and the band position detector. The mesh structure comprises the weft 113 and the warps 115 (in FIG. 4 only a single warp 115 is visible due to the cross-sectional view). Due to the open structure of the mesh, the central area 114 (that is: the whole area between the two bands 116) is substantially transparent. However, in the edge areas the filler material 117 being non-transparent is substantially non-transparent. The band position detector comprises a light source 440. Light from the light source 440 propagates in different directions shown by the arrows 442 and 444. Due to the non-transparency of the filler material 117 and the dense packing of the granules, the band in the edge area 116 is substantially non-transparent and light in the direction of the arrow 442 is either reflected or absorbed and does not propagate through the filler material 117, while light travelling in the direction of arrow 444 propagates without being obstructed by the filler material 117.

A light detector 450 comprises an array of light sensitive elements 452 (such as a linear CCD). It is provided at the opposite side of the belt 110 in order to detect where light is obstructed by the filler material 117. Light travelling in the direction of the arrows 442 is obstructed by the filler material 117. Consequently, the light sensitive elements 452 at the opposite side of the filler material 117 in the band sense a low level of light. Light travelling in the direction of arrow 444 is not obstructed by the filler material 117 and can reach the light sensitive elements 452. These light sensitive elements 452 will sense a high level of light. By comparing the light levels sensed by the lights sensitive elements 452, the band position detector is able to determine the position of the band above the light detector 450 and therewith the lateral position of the belt, as the areas of high and low light levels will move along the array in accordance with the lateral movement of the belt.

By appropriately commanding the steering roller 124, the lateral position of the belt 110 may be controlled, for example by employing a traditional feedback controller.

In a rather simple, alternative embodiment a light detector 450 with only a single light sensitive element 452 is used, for example in the position that is during normal operation at the opposite side of the band (with regard to the light source 440) such that the filler material 117 obstructs the light. When the belt 110 moves laterally, at some point the band is no longer above the light sensitive element 452, and the band position detector will detect that the band, and therewith the belt 110, has moved too far off in the lateral direction. Drawback of this embodiment is that the single light sensitive element 452 by itself is not able to detect if the lateral position of the belt 110 deviates in a negative or a positive direction.

Figure 6A:
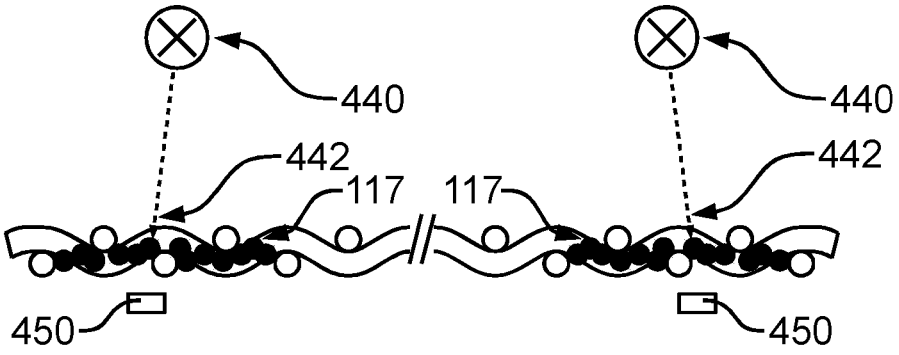
Figure 6B:
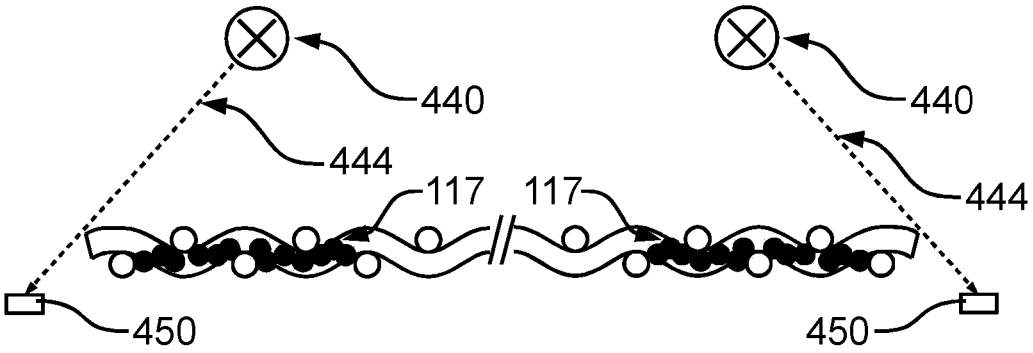
Figure 6C:
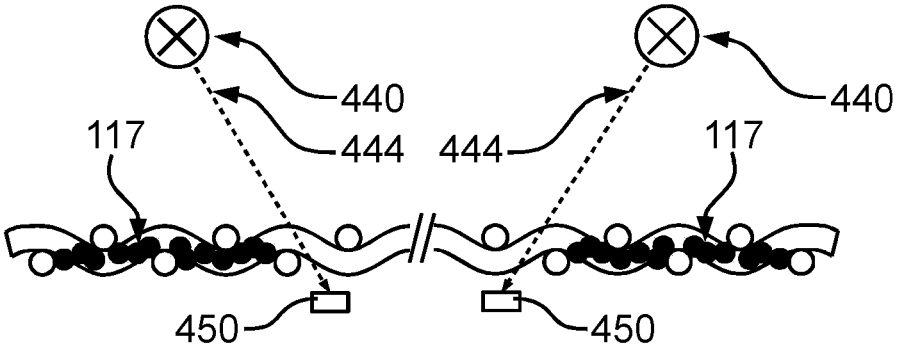

This disadvantage can be overcome by using at least two light detectors 450, or alternatively a single light detector 450 with two or more light sensitive elements 452. These two light detectors 450 may be positioned in various configurations, for example (FIGS. 5A-D and 6A-C):

- both behind the normal position of the band (with regard to the light source 440) such that both light detectors 450 normally detect a low light level (FIG. 5A),
- one behind the normal position of the band and one outside the normal band area, beyond the distal edge of the band (FIG. 5B),
- one outside the normal band area and inside the central area 114, and the other behind the normal position of the band (FIG. 5C),
- both outside the band area, one beyond the distal edge of the band, and one inside the central area 114 (FIG. 5D), and in case both edge areas are provided with a band one light detector 450 for each band:

- both behind the normal position of their respective bands (FIG. 6A),
- both outside their respective band areas, beyond the respective distal edges of the band (FIG. 6B), and
- both outside their respective band areas and inside the central area 114 (FIG. 6C).

Alternative methods for detecting the lateral position of the band is by making use of the reflectiveness or non-reflectiveness of the filler material 117 by placing the light detector 450 at the same side of the belt 110 as the light source 440. In such an embodiment the background of the belt 110 should distinguish from the filler material 117 by having the opposite property. As an alternative to a non-reflective background, no background may be present in the sense that opposite the position of the band there is no surface near the belt resulting in the light from the light source 440 dispersing into empty space if not reflected by the filler material 117.

Furthermore, instead a combination (or combinations) of a light source 440 and multiple light sensitive elements 452, it is also possible to use multiple light sources 440 and a single light sensitive element 452 together with some features to distinguish between the light from the different light sources 440, such as logic to excite the light sources 440 at distinctive moments in time.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A belt conveyor system comprising:

an endless mesh belt, the belt having a mesh structure and having edge areas at the lateral sides;

a drive mechanism drivable by a drive motor to rotate the belt; and a steering roller supporting the belt and arranged for steering the lateral position of the belt, wherein an edge area comprises a band running substantially parallel to the lateral sides, the band comprising an elastic filler being provided inside the mesh structure, the elastic filler being discernible from the mesh structure, and wherein the belt conveyor system further comprises a band position detector for detecting the lateral position of the band.

2. The belt conveyor system according to claim 1, wherein the filler is substantially opaque and the band position detector comprises a light source and a light detector positioned on opposing sides of the band and wherein depending on the lateral position of the belt light from the light source is substantially blocked or not by the band.

3. The belt conveyor system according to claim 1, wherein the band position detector comprises a light source and a light detector positioned on the same side of the band and wherein depending on the lateral position of the belt light from the light source is substantially reflected to the light detector.

4. The belt conveyor system according to claim 3, wherein:

the filler is substantially reflective, or the filler is substantially non-reflective and a substantially reflective surface is provided at the side of the mesh opposite the light detector.

5. The belt conveyor system according to claim 2, wherein the light detector comprises an array of light sensitive elements positioned along at least part of a lateral axis of the belt.

6. The belt conveyor system according to claim 1, wherein the filler material does not extend outside the mesh structure.

7. The belt conveyor system according to claim 1, further comprising a suction plate disposed along at least part of the surface of the belt and comprising a suction area provided with suction holes, and wherein the edge area comprising the band does not overlap with the suction area.

8. The belt conveyor system according to claim 1, wherein both edge areas comprise a band.

9. The belt conveyor system according to claim 8 wherein the two bands are positioned substantially symmetrical in the belt.

10. The belt conveyor system according to claim 1, wherein the filler comprises rubber.

11. The belt conveyor system according to claim 1, wherein the belt is seamless.

12. The belt conveyor system according to claim 1, specifically arranged for conveying sheets of registration media in a reprographic apparatus.

13. A reprographic apparatus comprising the belt conveyor system according to claim 12.

* * * * *